US005834714A

United States Patent [19]

Berger et al.

[11] Patent Number: 5,834,714

[45] Date of Patent: Nov. 10, 1998

[54] DOUBLE ACTUATOR ELASTOMERIC SWITCH

[75] Inventors: John W. Berger, Laguna Niguel; Ted L. Nichols, Santa Ana; Andry Kertatama, Montebello; James F. Gust, Temecula, all of Calif.

[73] Assignee: Staco Switch, Inc., Costa Mesa, Calif.

[21] Appl. No.: 641,414

[22] Filed: Apr. 30, 1996

[51] Int. Cl.[6] ..... H01H 1/10; H01H 9/26; H01H 13/70

[52] U.S. Cl. ..... 200/5 A; 200/1 B; 200/5 R

[58] Field of Search ..... 200/1 B, 5 R, 200/5 A, 512–517, 341–345, 339, 520–552, 553–574, 306

[56] References Cited

U.S. PATENT DOCUMENTS

| | | | |
|---|---|---|---|
| 3,932,722 | 1/1976 | Obata et al. | 200/5 A |
| 4,366,355 | 12/1982 | Oelsch | 200/5 A |
| 4,376,238 | 3/1983 | Martin | 200/1 B |
| 4,527,030 | 7/1985 | Oelsch | 200/5 A |
| 4,604,509 | 8/1986 | Clancy et al. | 200/5 A |
| 4,668,843 | 5/1987 | Watanabe et al. | 200/5 A |
| 4,677,268 | 6/1987 | Nemeth et al. | 200/159 B |
| 4,720,609 | 1/1988 | Hochgesang et al. | 200/5 R |
| 4,760,221 | 7/1988 | Yoshida et al. | 200/5 A |
| 4,967,043 | 10/1990 | Killarney | 200/1 B |
| 5,117,076 | 5/1992 | Damitio | 200/344 |
| 5,268,542 | 12/1993 | Voll | 200/5 A |
| 5,350,890 | 9/1994 | Fairbrother et al. | 200/5 R |
| 5,510,584 | 4/1996 | Norris | 200/1 B |
| 5,559,311 | 9/1996 | Gorbatoff | 200/1 B |

*Primary Examiner*—Peter S. Wong
*Assistant Examiner*—Bao Q. Vu
*Attorney, Agent, or Firm*—George F. Bethel; Patience K. Bethel

[57] ABSTRACT

A switch for making multiple contacts formed as an elastomeric molded body having a base with a ring of material molded therewith to the base, and attached to the base by a web. An interior cylindrical member is supported within the ring of material by another web. Electrically conductive media is formed on the ring and on the interior cylindrical member. The switch is mounted on a board having multiple stationary contacts that can be contacted by the conductive surfaces on the ring and the conductive surface on the interior cylindrical member.

22 Claims, 5 Drawing Sheets

FIG. 5
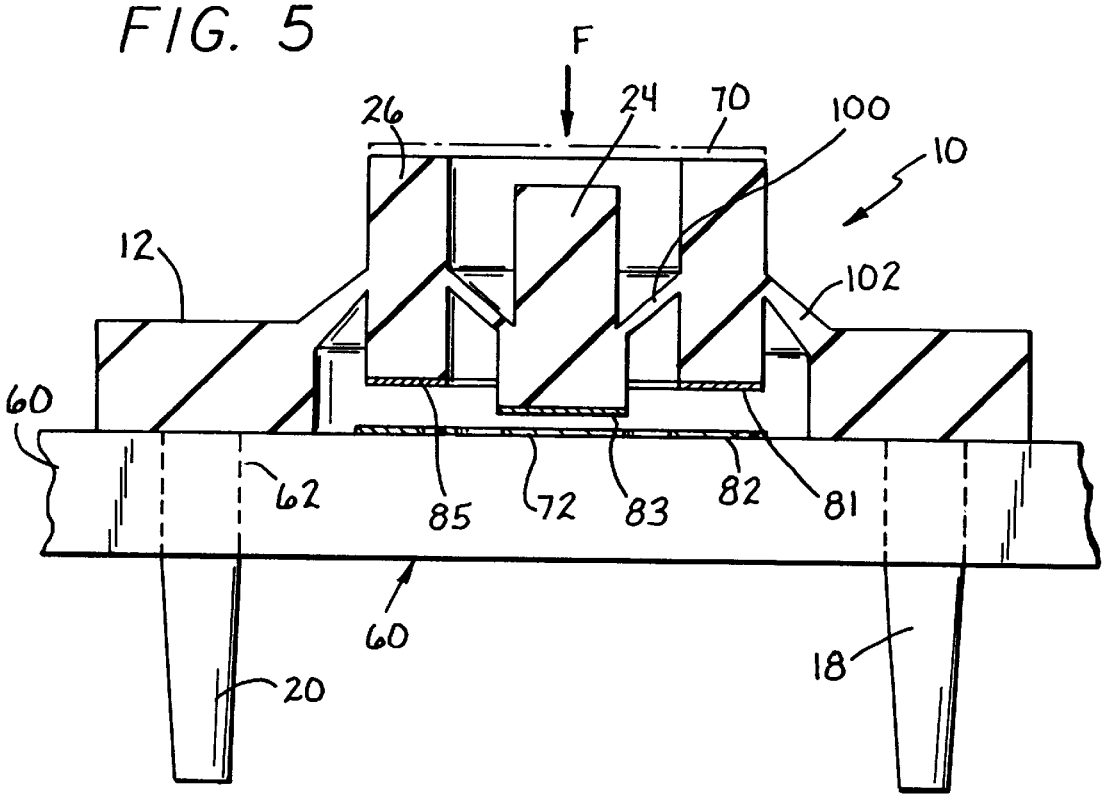
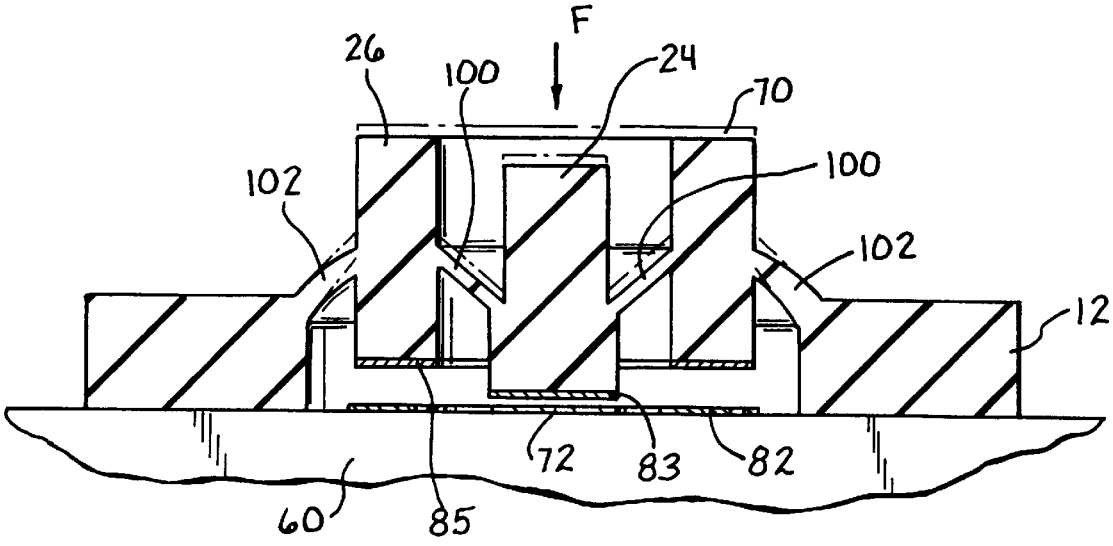
FIG. 6

DOUBLE ACTUATOR ELASTOMERIC SWITCH

FIELD OF THE INVENTION

The field of this invention lies within the art of electronic and electrical switching. It specifically resides within the field of electronic and electrical switching for components that can be mounted on a switch board, a circuit board, or other mounting means. The switch provides for plural contacts for the make and break functions, so that two or more switch functions can be combined for actuation within one particular switch. The switch is further enhanced by the fact that it resides within the field of a singularly molded switch formed from an elastomer.

BACKGROUND OF THE INVENTION AND PRIOR ART

The background of this invention lies within the art of electrical or electronic switching with respect to providing switches for a plural or multiple group of switching areas and functions. The switch art in particular involves the making and breaking of a contact for purposes of making and retaining a contact or, making and breaking through a momentary switch function or similar type function.

Many switches of the prior art have incorporated mechanical actuators which provide for a make and break function. The make and break function or retention of the making function incorporates mechanical actuators to provide a certain degree of spring bias. This spring bias allows for a switch function to be articulated manually by a person's fingers or hands. The spring bias is sometimes provided by coil springs, leaf springs, over center reaction components, or other analogous functional equivalents.

A particularly bothersome and difficult switching function is when plural switching or a double pole function is to be incorporated in one particular switch module. This is due to the fact that the make and break function of the switch requires certain variable contactors and mechanical linkages or interconnects which create a complicated plural or double pole switch function. The parts and elements can be extremely complex and inter-related to provide for the plural actuation switch function.

Another problem with regard to multiple double pole or plural switch functions is not only the actuator, but the fact that various types of such switches are not protected from hostile environments. These hostile environments can cause switch failure or in some cases merely poor and unreliable operation.

Another point of note is that the prior art as to conductive rubber switches is such wherein they have a single actuation. Inotherwords conductive rubber switches of the prior art incorporate a single actuation which does not provide the double actuation and switching which has been a long felt and desired need.

This invention provides for an elastomeric switch which makes plural contact with a small number of parts. There are no complicated actuators which are used. The switch of this invention supplants the use of normally required separate switch housings, spring biasing, actuators, and a bearing surface through the utilization of a single elastomeric switch that can make plural contacts.

The switch of this invention integrates the multiple or double pole functions into a single movable switch part. To this extent, the single elastomeric switch is formed of a seamless design. This allows for a waterproof material that is extremely durable around hostile environments such as liquids, dust and various chemicals.

The switch provides for a plural action part. It is particularly desirable because it is such where it develops a single linear movement that can be provided with two or more switch functions. In the particular embodiment shown herein, the two switch functions have been shown but can be enhanced to create plural switch functions beyond two.

The invention specifically provides for displacement positions which create double pole or multiple switching functions. This is particularly of note when considering the fact that the switch is a conductive rubber switch which provides double, multiple or plural actuation. All known conductive rubber switches provide a singular actuation. The various features of this invention are such where they are a significant improvement over the prior art, as will be appreciated in the specification set forth hereinafter.

SUMMARY OF THE INVENTION

In summation, this invention provides for an elastomeric switch made from a single movable part that provides the switch housing, the spring bias, the actuator, and movable contact surfaces all within one switch unit for multiple or double pole functions and multiple contacts.

More particularly, the invention is an elastomeric multiple electrical or electronic switch. The switch is formed as a single movable part that can be used to provide the various functions of the switch housing. The spring bias of the switch is inherent within the nature of its elastomeric material. At the same time, the actuator function of the movement of the switch and the contact surfaces are combined with the switch for improved operability.

The foregoing multiple functions provided by the various parts are combined in one switch part. This is enhanced by a seamless design which is both of a waterproof material and durable within the confines of hostile environments such as caustic or acidic liquids, dirt, dust, and grease.

The switch forms a double pole or plural action part. The plural action part is such where it provides for multiple, or plural making and breaking of contacts. This is driven by a desirable single linear movement which creates the plural contacts on a multi stage basis. The overall switch creates plural displacement positions through one switching function or one linear movement that creates the multiple functions at each displaced position.

As can be appreciated, the single elastomeric switch of this invention is a broad step over the art and will be appreciated in light of the following specification and claims.

BRIEF DESCRIPTION OF THE DRAWINGS

FIG. 5 shows a midline sectional view through the switch in the direction of lines 5—5 of FIG. 1.

FIG. 6 shows the same view as FIG. 5 with the switch moving initially prior to making contact.

DESCRIPTION OF THE PREFERRED EMBODIMENTS

Figure 1:
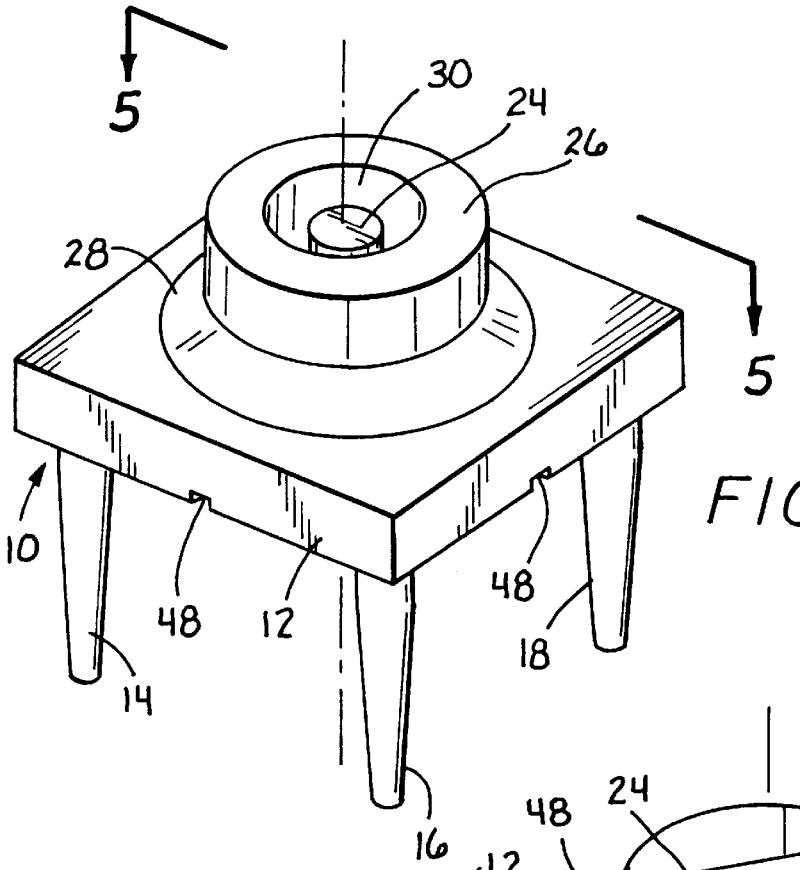
FIG. 1 shows a perspective view of the switch of this invention from what would normally be the exposed or upper surface thereof.
Figure 2:
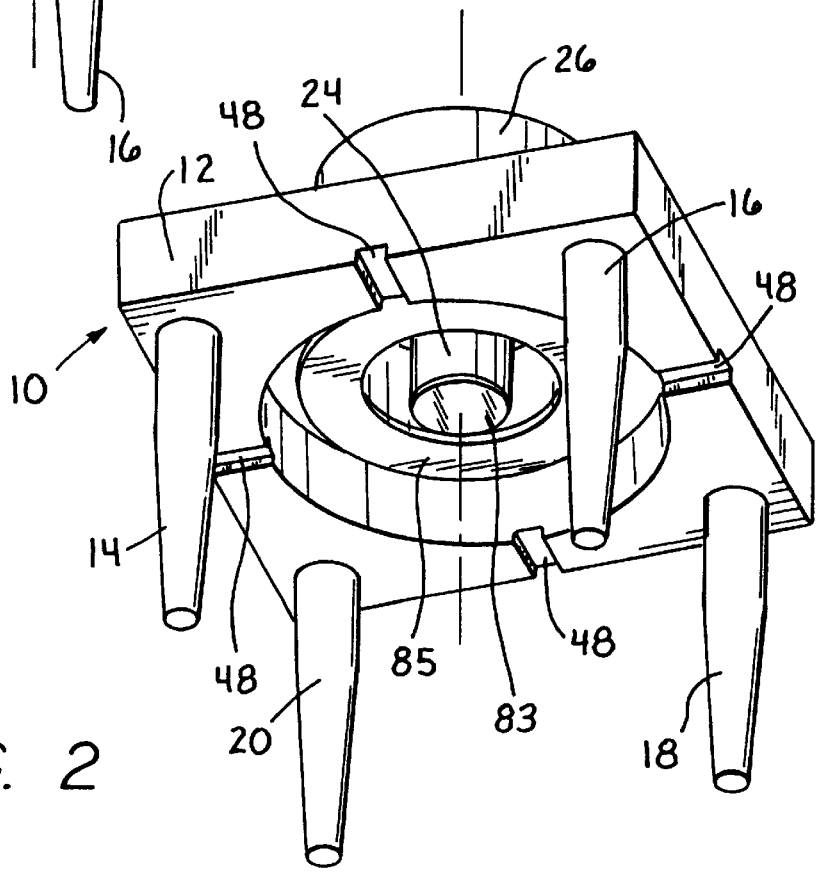
FIG. 2 shows a perspective view of the switch from what would normally be a lower or unexposed surface.

Looking at FIGS. 1 and 2, it can be seen that a single molded switch, or switch body 10 is shown. The switch 10 has a single molded configuration that is relatively seamless, that is to say it does not have any joints that have been bonded, molded, or cemented together except for the conductive material of the movable contact as described hereinafter. The switch body 10 is made of silicone rubber, which can be a fluorosilicone. This enhances the durability from the standpoint of oil deterioration and provides longevity and greater performance. The switch can also be molded from a single molded Neoprene, Butadiene, Styrene, various Co-Polymers, Butyl Acetate as well as other elastomeric types of materials.

The switch 10 has a rectangular base portion 12 which has four legs 14, 16, 18 and 20 extending therefrom. These four respective legs 14 through 20 are made of the same type of elastomeric material and molded in the entirety with the whole switch body 10. These will be detailed insofar as to the overall switch configuration, and as to the showing of FIGS. 4 and 5. The rectangular base portion 12 can be of any configuration or outline so long as it supports the switch on a mounting board or plate that provides the stationary contacts. For instance base 12 can be cylindrical, oblong or any other configuration so long as it supports the entire switch and can be connected to an underlying switch board or mounting. Multiple numbers of switches such as switch bodies 10 can be combined on a keypad or keyboard for creating a multiplicity of double action switches.

Looking further at the configuration of the switch body 10, it can be seen that an inner cylinder, internal, central, or inner member 24 and an outer ring, or peripheral member 26 are shown. These respective inner and outer members or portions perform the switch function as will be detailed hereinafter. The respective inner portion or cylinder 24 and outer portion or ring 26 are connected to and by webs or sloping walls, one of which is not externally shown. The other one is shown as a sloping web having an outer wall surface 28 which has been shown as a circumferential skirt, web, or wall portion connected to the circular outer ring 26. The sloping web or wall portion forms the outer surface or wall portion 28 of a web 102 as specified hereinafter starting with FIG. 5. Between the inner cylindrical portion 24 and the outer ring portion 26, a space 30 is maintained.

In order to cause the switch to function, a plate, contact, or driving member can be placed across and over the top surfaces of the cylinder 24 and outer ring 26. This can be done in the form of a contact plate as can be seen in the figures starting with FIG. 5 or in the form as shown in FIG. 3.

Figure 3:
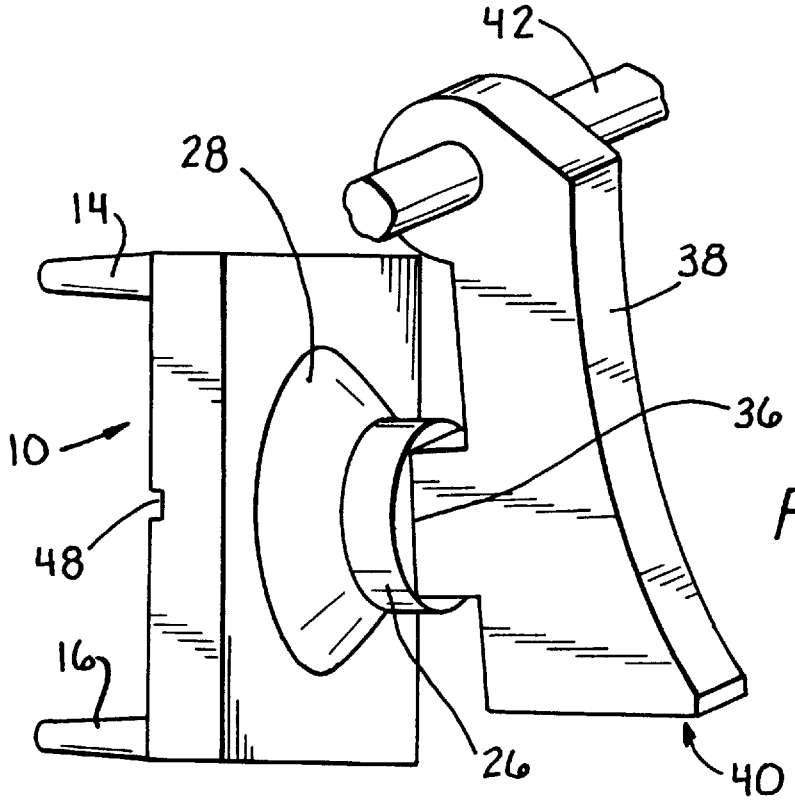
FIG. 3 shows a side perspective view of the switch with a means for switch movement.

FIG. 3 specifically shows the switch body 10 with the outer ring 26 and inner cylinder 24 covered by a surface, or contact plate 36 formed as a hand trigger for receiving an operator's index finger against its curved surface 38. The foregoing forms a trigger 40 for pivotal movement about a rotational axis provided by a pin 42 that allows the trigger 40 to swing on the pin 42.

Looking more particularly at the base of the rectangular base portion 12, it can be seen that slots, grooves, channels, passages or openings 48 are shown at each respective major edge surface. These slots, grooves, channels, passages or openings 48 are at each major edge surface to allow for air to escape as the switch is actuated in the plunger movement of the outer ring 26 and inner cylinder 24. These channels can be in the form of ports of any configuration venting from the switch interior to the exterior surface. The slots, grooves, channels, passages or openings 48 provide for the capability of the switch when it is depressed to drive the air therefrom to allow for easy depressing activity, while at the same time preventing any kind of suction. However, if the switch were to be operated with a pneumatic principle for greater resiliency and cushioning, the elimination of the slots, grooves, channels, passages or openings 48 would provide for an air cushion as it is actuated. However, this might not always provide for as consistently an operable switch.

Figure 4:
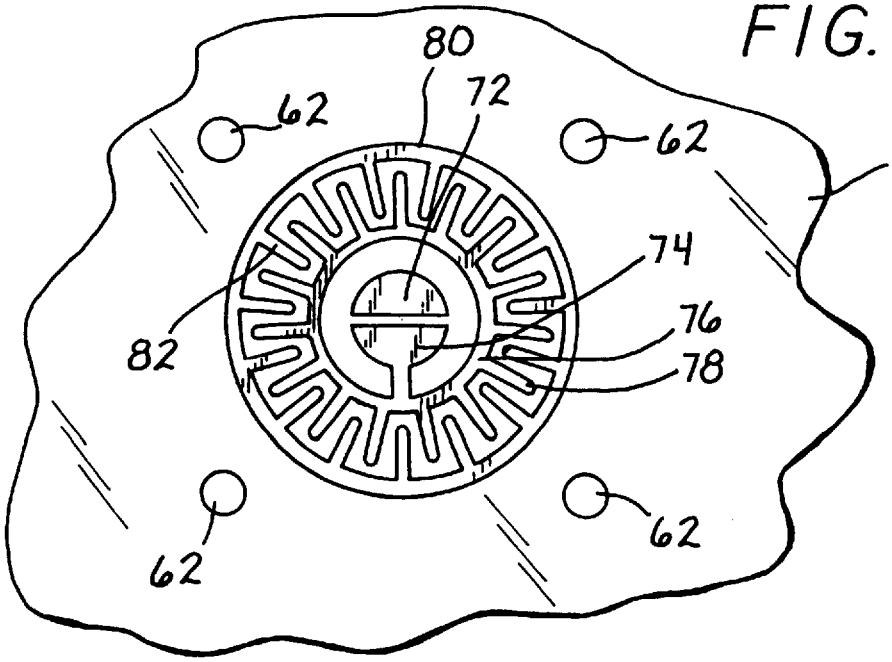
FIG. 4 shows a fragmented plan view of the underlying surface or stationary contacts on which the switch makes contact.

Looking more particularly at FIGS. 4 and 5, it can be seen that the switch body 10 is mounted to a board surface or substrate 60. The board surface or substrate 60 can be in the form of a switch board or any other board surface such as a circuit board having leads to which the switch is connected. The board or substrate 60 provides the stationary contacts which the switch body makes and breaks contact with.

In order to mount the switch body 10 to the switch board or substrate 60, the legs 14, 16, 18 and 20 are pulled through openings 62 that can be seen in the switch board 60 and the showing of FIGS. 4 and 5. These openings 62 allow for the legs to be pulled therethrough and be seated. This is accomplished by virtue of the fact that the legs 14 through 20 are made of an elastomeric material and expand at the back of the switch board 60 to maintain the switch 10 in its tightened and seated contact. The elastomeric nature of the legs causes them to expand outwardly at the base of the switch board 60 and maintains the switch in its surficial contacting relationship.

In order to provide for a driving surface against the switch, a plate such as the trigger surface 36 is utilized overlying the switch 10. This plate or surface can be in the form of any member that creates a surface to which a driving force such as that in the direction of force F can be utilized. This plate or surface is shown in the form of an analogous surface to 36 as a plate or driving surface 70 against which force F is imposed.

Looking more particularly at FIG. 4, it can be seen that the switch board or substrate 60 has been provided with a radially extending series of arms connected to circular portions. These provide the switch base or stationary contact functions.

When the switch functions, the inner cylinder 24 or internal or central member first makes contact with switch board or stationary contact 72. Switch board or stationary contact 72 is connected under the board to any particular circuit which is to be switched. The common or other portion of the circuit is shown in the form of a stationary contact surface 74 or the board or substrate 60 connected to a circular ring 76 having arms 78 extending therefrom. This allows for a bridging contact between contact 72 and 74.

Stationary contact 74 is the common and contact 72 is connected to the components to be switched.

The second switch function is effectuated by the outer ring 26 making contact with the stationary contact ring 80. Stationary contact ring 80 has radial arms 82 that cause a bridging from the common 74 and arms 78 with the arms and circular portions and arms 82 of the second switch function. In effect, the outer ring, or peripheral member 26 makes the second contact after the inner cylinder 24 has made contact in the manner to be described hereinafter.

The switch board 60 and the stationary contact surfaces can be of gold. The board 60 can also be of a flex circuit design. The switch board 60 provides for the stationary contacts of the switch 10, which can also be of any other suitable conductive material for an electrical circuit.

As an alternative the stationary contacts such as contacts 72 through 82 on the switch board 60 can be printed with conductive ink or any type of electrically conductive surface. Also, the switch board or substrate 60 can be of glass or other materials instead of a circuit board. Such conductive inks can also be used for the stationary contacts in conjunction with capton, mylar, glass and a variety of other substrates for the board 60.

Looking more particularly at FIG. 2 again, it can be seen that the outer ring or peripheral member 26 and inner cylinder or central member 24 respectively have an outer contact 85 and an inner contact 83. These respective outer and inner contacts 85 and 83 create the moving contacts for contacting the stationary contact on the switch board 60. These moving contacts can be in the form of any conductive materials such as conductive rubbers, plated materials, printed or silk screened thereon, or any other suitable process in any particular way on the contacting surface of the cylinder 24 and ring 26.

In furtherance thereto the rubber contact surface of ring 26 and cylinder 24 can be a conductive ink as previously described or a conductive rubber such as carbon filled silicone rubber or elastomer. It can also be a carbon, or gold filled type of rubber. The process of application is such where the conductive surface is molded and emplaced on the surface as either integrally molded or a separate sheet which is molded on, or molded to the surface to form the outer and inner contacts 85 and 83. In this particular case, the carbon filled material is such where it has a resistivity of 10 ohms-centimeter. This allows for sufficient conductivity of the surfaces 85 and 83 to provide the moving contacts and conductivity to the stationary contacts 72 through 82.

Looking more particularly at FIGS. 5 through 9, it can be seen that the force F on the plate 70 is starting to move the switch 10 in FIG. 5 downwardly. When looking at the cross section of the switch 10, it can be seen that the outer ring 26 and the inner cylinder 24 are joined by a web or angular ring member which circumscribes and is attached to the inner cylinder or contact 24 by being molded thereto with the outer ring or contact 26. This inner web or connector wall is formed as web 100 having relatively parallel walls between the respective outer wall portions so as to provide for uniform stress.

The outer ring 26 is connected to the base 12 by means of a second web extending downwardly from the outer ring 26. This appears as the outer skirt 28 or surface of the wall 102 described hereinbefore. This second web is in the form of a support, web or bracing member or wall 102.

It should be noted that bracing member strut or web 102 is such wherein it has peripheral cross sectional walls that extend from the outer ring 26 in a non-parallel manner. Less cross sectional thickness of material extends toward the outer ring 26 than toward the base 12. Various design configurations can be utilized in order to provide for this. However, generally speaking the wall should be such where it flexes in a manner by having notches, indentations, or non-uniform spacing between the walls and/or non-uniform thickness so as to provide for the function of the snap over element as stated hereinafter. Also, it has been found to be preferable that the walls or the axis of the web 102 should be such where it is attached to the base 12 and outer ring 26 so as to project upwardly at an angle between 30° and 60°. In this particular case, the angle is approximately 45° from the base 12 extending upwardly to the outer ring 26.

Looking more particularly at FIG. 5 and the ensuing figures, it can be seen that the switch 10 through force F is beginning to move downwardly.

In FIG. 6, it can be seen that the inner web 100 and outer web 102 have not been appreciably deformed. They have been flexed to the point where the outer web is beginning to bend or buckle downwardly with a bending moment through its neutral axis. When the outer web 102 begins to flex, it provides for a non-linear reaction force until the switch snaps over when it makes its contact. This non-linear force which increases, causes a reaction against force F. This reactive force continually increases the force against movement by force F until the point of the switch 10 snapping over or going beyond its center of reaction, and making its contact as will be seen in the ensuing figures. Thus, at this point in FIG. 6 the inner web 100 has been displaced but not deformed. The outer web 102 is being displaced and deformed along its neutral axis to create an ever increasing reactive force constant against the force of force F. Also, as can be seen in FIG. 6 the inner contact surface 83 is about to make contact with the ground 74 and first stationary contact 72.

Figure 7:
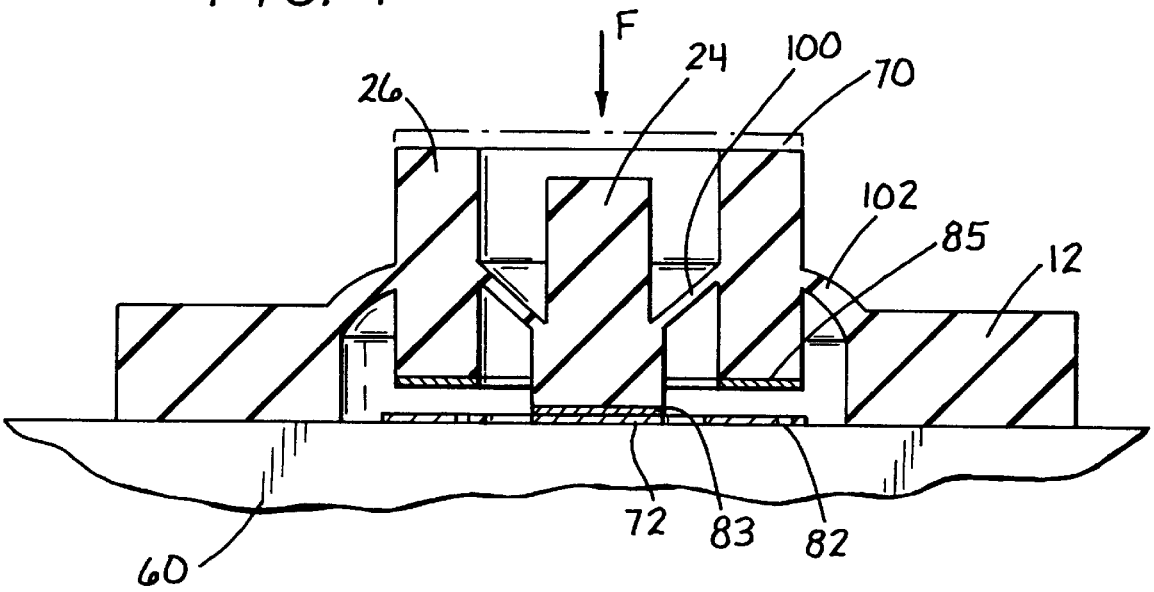
FIG. 7 shows the same sectional view as FIG. 6 with the switch in further displaced relationship and making initial contact.

Looking more particularly at FIG. 7 it can be seen that the contact 83 has just made contact with the stationary contact 72 and with the contact 74 which is the common. At this particular point, the inner web 100 has still not begun to collapse but has been carried downwardly along with the inner and outer portions 24 and 26. Also, it should be noted in FIG. 7 that only the outer web is deflected at this point which provides the continuing reactive force against force F.

Figure 8:
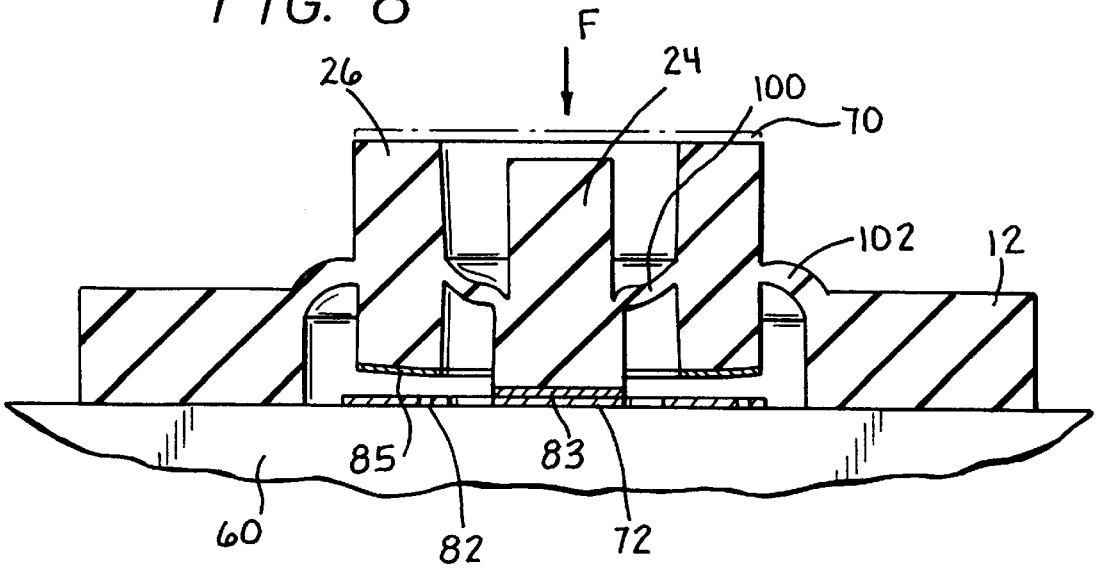
FIG. 8 shows the switch of FIGS. 5, 6 and 7 in a further displaced relationship from that of FIG. 7.

In FIG. 8, it can be seen that the switch has been moved even farther down by force F and that the web 102 is applying the reactive force in a buckled or collapsed manner while web 100 has also been flexed. This is at the point of snap over where the two respective webs 100 and 102 collapse beyond their respective midpoint positions so that the over center relationship of the snap over creates a deflection and contact movement downwardly.

Figure 9:
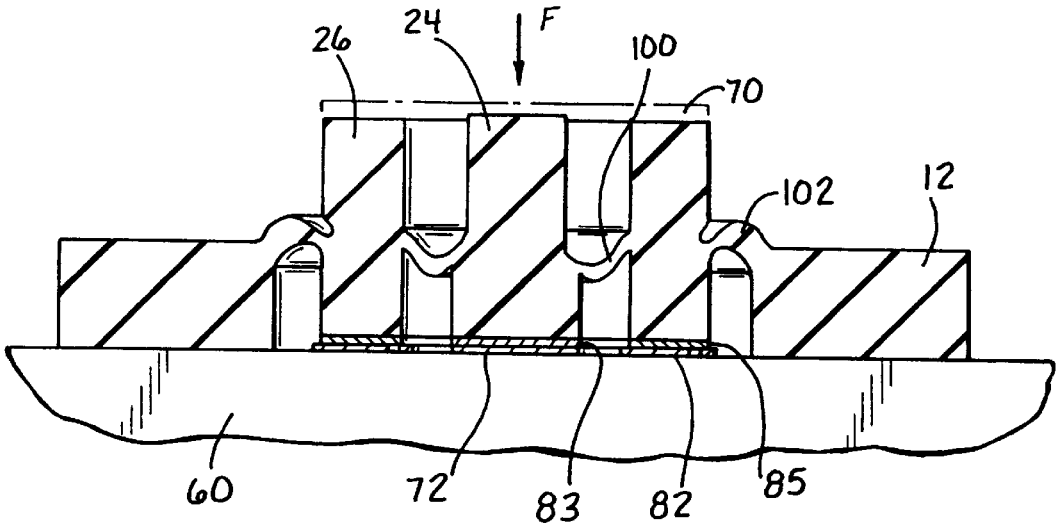
FIG. 9 shows the switch making final contact with both contacts, and is similar to FIGS. 5, 6, 7 and 8.

Looking further at FIG. 9, it can be seen that snap over or movement beyond the elastomeric reactive force has occurred and full contact is made with the outer contact ring 85 and the stationary contact comprising contact arms or extensions 82 and ring 80. At this point, full contact has been made between the respective movable contacts and the respective stationary contacts. This thereby causes the double switching or double pole contact functions to occur. Upon release of force F, the movable switch members will move back and snap into their normal position through the reverse of the articulated movement described in the figures so that the switch then resides back in its unforced and unactuated position of FIG. 5.

Figure 10:
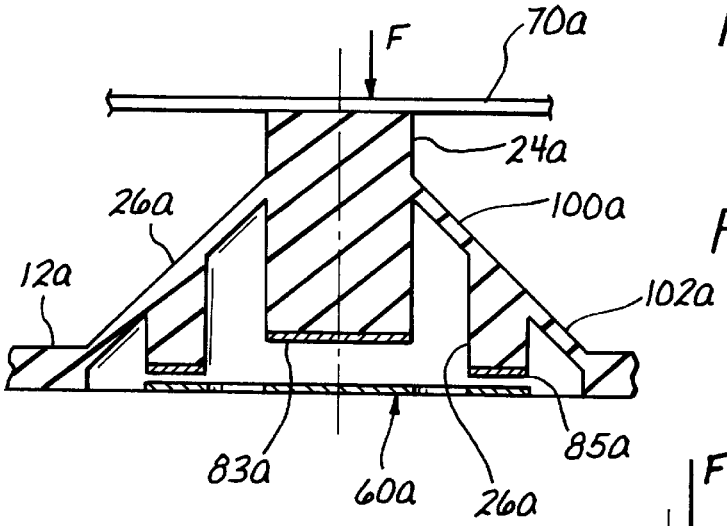
FIG. 10 shows a cross sectional view similar to FIG. 5, but is an alternative embodiment of a different configuration as to the webs and other characteristics.
Figure 11:
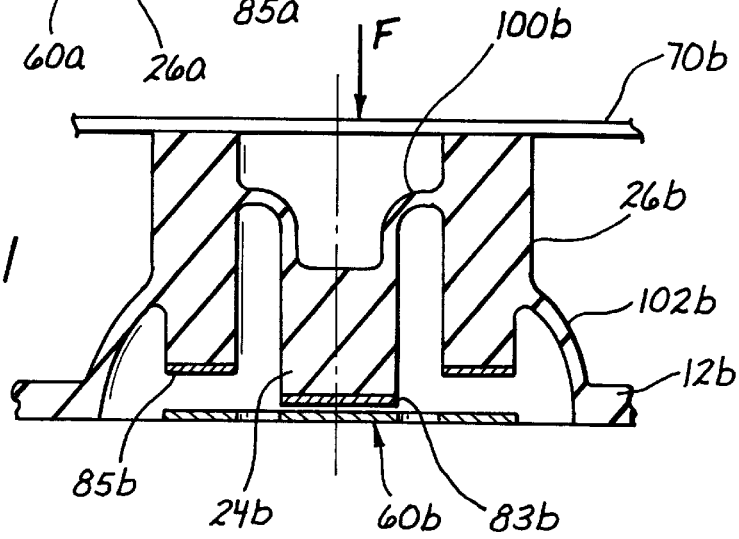
FIG. 11 shows another alternative embodiment that is analogous to FIG. 5 as to the cross section thereof.

Looking more specifically, at FIGS. 10 and 11 it can be seen that there are two alternative embodiments shown.

These two respective alternative embodiments function generally in the way that was shown as previously described. However, one causes the inner cylinder or central member to make contact after the outer ring or peripheral member makes contact which is the reverse of FIGS. 5 through 9. For purposes of reference, the respective webs and other portions will be described with alternative letter nomenclature as to the two respective alternative embodiments.

In particular, FIG. 10 shows a base mount 12*a* that is analogous to the rectangular base 12 which can also have any periphery besides being rectangular. Attached to the base 12*a* is an outer web 102*a* which is similar to the outer web 102. An actuator plate 70*a* analogous to plate 70 is shown for receiving force F.

An inner web 100*a* is shown which functions in the similar manner as the inner web 100 of the previous embodiment described herein. The interior is shown with an inner cylinder 24*a* and an outer ring 26*a*. The respective inner cylinder and outer ring have conductive material 85*a* on the outer ring 26*a* and conductive material 83*a* on the inner cylinder 24*a*.

The operation of the switch is such wherein FIG. 10 shows the switch body in general elevated orientation as in FIG. 5 above the switch pad, board or plate 60*a*. This orientation above the switch pad, board or plate 60*a* functions so that a contact can be made in a similar manner as the movement of FIGS. 5 through 9. However, in this particular case the outer ring 26*a* with its conductive surface 85*a* makes the first contact. This first contact of 85*a* is then subsequently supplemented by the second contact of the cylinder 24*a* with its contact 83*a* making the second contact. This is the reverse of the first embodiment of FIGS. 1 through 9.

Thus, in somewhat measured sequence the two respective contacts 85*a* and 83*a* are such wherein 85*a* makes the first contact. The outer ring is in a different orientation from that of FIGS. 5 through 7, causing the inner contact 83*a* on the cylinder 24*a* to make the second contact. All other portions of the switch board and the stationary contacts can be the same as shown in FIG. 4. Of course the electronic orientation as to the respective make and break first and second contacts are effectively connected and oriented for the electronic usage of the switch.

Looking more specifically at FIG. 11, it can be seen where the analogous functions are shown such that a force F against plate 70*b* causes a deformation of the switch mounted on the base 12*b*. The outer web 102*b* and inner web 100*b* are shown respectively analogous to the prior webs 100 and 102. The stationary contacts on board 60b was also shown analogous to the switch board 60.

The outer ring 26*b* analogous to ring 26 and inner cylinder 24*b* are also shown. Conductive material analogous to the foregoing conductive material 85*b* and 83*b* are shown respectively connected to the outer ring 26*b* and inner cylinder 24*b*.

The contact made by the switch is differentiated from that of FIG. 10 and is analogous to FIGS. 5 through 9 as to the contact sequence. This sequence is such where the conductive material 83*b* makes the first contact and the conductive material 85*b* makes the second contact. Thus, the general function is similar to that as far as the contact sequence to the first embodiment shown in this specification.

Other multiple configurations can be utilized whereby multiple webs 100 and 102, or such webs as 100*a* and 102*a* can be formulated to provide for the actuation of multiple contacts or a double pole function. In effect, the outer ring or peripheral member 26 can be built up as multiple rings or outer peripheral members around an interior cylinder or central member 24 thereof in concentric relationship to provide for multiple contacts against multiple stationary contactors on a switch board 60. Thus, the plurality of switch contacts between the stationary contacts and the moving contacts can be increased by having plural numbers of concentric outer contacts and inner contacts. These contacts or rings terminate in a single cylindrical area. Multiple switch members exceeding two extend outwardly such that rings 26, 26*a* and 26*b* can be increased to multiple rings beyond the first outside ring to provide plural contacts in excess of two. In this case, the stationary contacts would also be placed on the stationary contact switch board such as board 60 to be such where they accommodate the multiple contacts above two in number as previously set forth in the first embodiment.

From the foregoing it can be seen that the invention is a step over the art of switching which should be read broadly in light of the following claims.

We claim:

1. A switch for making multiple sequential contacts comprising:

an elastomeric continuously molded single body having a base;

a ring molded integrally with said base and attached to said base by a web;

an inner member supported within said ring by a second web said inner member and said second web both integrally molded with said ring to form in part said continuously molded single body;

an electrically conductive media on at least a portion of said ring;

an electrically conductive media on the inner member supported by said ring;

means for mounting said base to a board member having multiple stationary contacts that can be contacted by the conductive surface on said ring and the conductive surface on said inner member in a sequential manner so that different contacts take place in sequence between the ring conductive material and the conductive material on the inner member to form sequential multiple contacting switch.

2. The switch as claimed in claim 1 further comprising:

extensions from said base which are integrally molded therewith of the same material as said base that extend through openings in said board member.

3. The switch as claimed in claim 1 further comprising:

air vents formed within said base.

4. The switch as claimed in claim 1 wherein:

said web extending from said base to said ring comprises a web with non-parallel cross sectional walls.

5. The switch as claimed in claim 4 further comprising:

said second web supporting said inner member to said ring is formed with parallel side walls.

6. The switch as claimed in claim 1 wherein:

said web supporting said ring extending from said base member extends upwardly toward said ring at an angle between 30° and 60° and has non-parallel side walls.

7. The switch as claimed in claim 1 further comprising:

a member extending across said ring and said inner member for simultaneously moving said ring and inner member for downward movement against said board; and, multiple stationary contacts on said board for making contact with the conductive material on said ring and said inner member wherein one of said stationary contacts on said board forms a common.

8. A multiple contacting switch for making multiple sequenced contacts comprising:

a single integrally molded elastomeric material formed as a continuously joined body with an outer peripheral member connected to a base member by a first web, and an interior member connected to said outer peripheral member by a second web; and, conductive material on said outer peripheral member and said interior member adapted for making multiple sequenced contacts with an underlying stationary contact surface.

9. The switch as claimed in claim 8 wherein:

the first web extending from said outer peripheral member to said base member has non-parallel cross sectional walls.

10. The switch as claimed in claim 9 wherein:

said second web extending from said outer peripheral member to said interior member comprises a web having parallel walls.

11. The switch as claimed in claim 8 wherein:

said outer peripheral member comprises a ring; and, said interior member comprises a cylindrical member.

12. The switch as claimed in claim 11 further comprising:

a board member upon which said switch is mounted having multiple stationary contacts with a common for making contact between the conductive surface on said ring and the conductive surface on said cylindrical member.

13. The switch as claimed in claim 8 further comprising:

elastomeric extensions formed as a single integrally molded item with said base member for extending therefrom into openings within a board member for elastomeric frictional engagement thereof.

14. The switch as claimed in claim 8 wherein:

said switch is formed with an outer peripheral member and an interior member at fixed spaced distances overlying said base member to provide for a fixed stroke.

15. The switch as claimed in claim 8 further comprising:

air passages within said base member to provide for air purging upon actuation of said switch.

16. A switch for making multiple sequential contacts comprising:

a first movable electrical contact;

a second movable electrical contact for making sequential contact after said first movable electrical contact;

means for providing solely elastomeric independent actuation forces between said first and second electrical contacts formed from a unitary molded elastomeric material on which said first and second movable electrical contacts are formed; and, said switch being mounted on an underlying substrate having stationary contacts.

17. The switch as claimed in claim 16 further comprising:

webs forming said independent actuation forces, wherein one of said webs is formed with non-parallel side walls.

18. The switch as claimed in claim 17 further comprising:

said first and second respective movable contacts being formed on an outer peripheral member and an inner member supported therebetween with one of said webs; and, said outer peripheral member is supported on a base member by said web with non-parallel side walls.

19. The switch as claimed in claim 18 further comprising:

elastomeric extensions unitarily molded to said switch for extending therefrom into said substrate.

20. A switch providing a double pole sequential switching function comprising:

a single continuous elastomeric molded material;

a first movable contact means integrally molded and formed on said single elastomeric molded material for making a first electrical contact with an underlying substrate;

a second movable contact means integrally molded and formed on said elastomeric molded material for making a second electrical contact sequenced after said first electrical contact with an underlying substrate; and, wherein said first and second movable contact means are separated in movement and supported by webs forming part of said single elastomeric molded material a specified distance which can be predetermined.

21. A double pole switch providing sequential movable contacts for making contact with an underlying substrate having fixed contacts comprising:

an elastomeric unitarily molded material;

a first movable contact means on said elastomeric unitarily molded material for making a first contact with said fixed contacts;

a second movable contact means on said elastomeric unitarily molded material for making a second contact with said fixed contacts; and, support means for said first and second movable contact means integrally formed in said elastomeric unitarily molded material having a predetermined cross-sectional thickness to create predetermined actuation forces between said first and second movable contact means.

22. An array of switches forming a switching matrix mounted on a substrate to form a keypad, keyboard or the like, each of said switches providing multiple sequenced contacts, comprising:

a plurality of molded elastomeric switch bodies each integrally formed with an outer peripheral member integrally formed and connected to a base member by an integrally formed web, and an interior integrally formed member integrally connected to and formed with said outer peripheral member by an integrally formed web; and, conductive material on each of said outer peripheral members and each of said interior members adapted for making sequential contact with a plurality of underlying stationary contacts on the substrate to form a multiple sequenced switching function.

* * * * *